US005927517A

United States Patent [19]

Lipman et al.

[11] Patent Number: 5,927,517

[45] Date of Patent: Jul. 27, 1999

[54] MERCHANDISING DISPLAY ASSEMBLY

[76] Inventors: Daniel Lipman; Melissa E. Lipman, both of 5 Taylor Ct., Lattingtown, N.Y. 11560

[21] Appl. No.: 09/025,667

[22] Filed: Feb. 18, 1998

[51] Int. Cl.[6] ..... B42F 7/00; A47B 96/06

[52] U.S. Cl. ..... 211/59.1; 211/106; 248/220.41

[58] Field of Search ..... 211/59.1, 87.01, 211/106, 57.1; 248/220.31, 220.41, 220.43

[56] References Cited

U.S. PATENT DOCUMENTS

| | | | |
|---|---|---|---|
| 2,618,390 | 11/1952 | Johnson . | |
| 3,452,959 | 7/1969 | Ishikawa | 211/59.1 |
| 3,547,392 | 12/1970 | Tanzer | 211/59.1 |
| 3,878,939 | 4/1975 | Wilcox . | |
| 4,170,392 | 10/1979 | Spevak . | |
| 4,509,648 | 4/1985 | Govang et al. | 211/59.1 |
| 4,723,663 | 2/1988 | Learn . | |
| 4,726,554 | 2/1988 | Sorrell | 211/59.1 |
| 4,788,784 | 12/1988 | Templin . | |
| 4,815,612 | 3/1989 | Leo, Sr. . | |
| 4,819,800 | 4/1989 | Wilson . | |
| 4,932,538 | 6/1990 | Gambello | 211/59.1 |
| 4,951,827 | 8/1990 | Moransais . | |
| 5,014,949 | 5/1991 | Niven | 211/59.1 |
| 5,050,733 | 9/1991 | Brennan . | |
| 5,083,668 | 1/1992 | Bushey | 211/59.1 |
| 5,303,830 | 4/1994 | Metcalf . | |
| 5,595,309 | 1/1997 | Bauer et al. . | |
| 5,673,803 | 10/1997 | Burback | 248/220.43 |

*Primary Examiner*—Daniel P. Stodola
*Assistant Examiner*—Jennifer Novosad
*Attorney, Agent, or Firm*—Collard & Roe, P.C.

[57] ABSTRACT

A merchandising display assembly for receiving display hooks for supporting and displaying articles of merchandise, comprising a planar mounting board having a flat front surface with a plurality of spaced apart bores extending therethrough in a predetermined pattern, and a rear surface. There is a collar surrounding each bore and extending back from the rear surface. The collar comprises a cylindrical side wall having a longitudinally extending slot along its uppermost point. The length of each collar is at least three times the diameter of each bore. Each bore and collar is adapted to selectively receive and frictionally retain a mounting hook. The merchandising display assembly further comprises several mounting hooks adapted for mounting on the board.

9 Claims, 4 Drawing Sheets

MERCHANDISING DISPLAY ASSEMBLY

BACKGROUND OF THE INVENTION

1. Field of the Invention

This invention relates to an assembly for displaying merchandise. In particular, the invention relates to a display assembly that can provide a high density of displayed items on easily repositionable hooks.

2. The Prior Art

Retail establishments often attempt to find new and more efficient ways of displaying merchandise. One traditional format is the "pegboard", which is a registered trademark of Masonite. Pegboard is a planar board that is usually composed of ⅛" or thicker hardboard that has been drilled to provide spaced horizontal and vertical rows of openings, generally positioned at 1" intervals. Cooperative bent wire hooks have been designed for removable connection to the Pegboard. The hooks have L-shaped end portions that are inserted through the Pegboard openings and pivoted down for support against a rear surface of the Pegboard. Each hook occupies at least two holes on the Pegboard, which wastes space if the displayed item is narrower than the distance between adjacent holes.

Therefore, it would be desirable to provide a display system with narrow profile hooks to obtain higher density and more varied displays. One such system is described in U.S. patent application Ser. No. 08/638,816, the disclosure of which is herein incorporated by reference. This application shows an improved display system that utilizes a board having a plurality of deep bores in which straight hooks are mounted. The hooks are inserted into the bores and are kept in place by the friction of the pins against the side walls of the bores. This method allows many more hooks to be placed on the board than with conventional pegboard, and provides for a more efficient, aesthetic appearance. However, while the deep side walls provide for strong, frictional retention of the hooks in the board, they also make it difficult to insert and remove the hooks.

SUMMARY OF THE INVENTION

It is therefore an object of the invention to provide a display assembly that allows for the display of many more items than with conventional pegboard.

It is another object of the invention to provide a display assembly in which the hooks can be easily inserted and removed.

These and other objects of the invention are accomplished by a display assembly for displaying merchandise comprising a substantially rigid, planar mounting board having a flat front surface with a plurality of spaced apart bores extending therethrough in a predetermined pattern, and a rear surface. There is a collar surrounding each bore and extending back from the rear surface. The collar comprises a cylindrical side wall having a longitudinally extending slot. The length of each collar is at least three times the diameter of each bore. Each bore and collar is adapted to selectively receive and frictionally retain a mounting hook.

The predetermined bore pattern comprises parallel rows and columns with substantially uniform spacing between the bores of the rows and of the columns. The uniform spacing comprises approximately one-half (½) inch spacing on center between the bores of the rows and of the columns.

The bore comprises a frusto-conical portion bordered by a beveled edge which forms and angle of approximately 45 degrees with respect to the front surface of the planar mounting board. An upwardly extending lip is arranged at the back of each channel and extends into the bore. The lip acts as a stop to prevent any of the mounting hooks from extending beyond the back of the collars and into the space behind the board.

The assembly according to the invention further comprises at least one mounting hook, which is comprised of a linear display section and an L-shaped mounting section having a perpendicular end. The L-shaped mounting section is adapted for insertion into the bore such that the perpendicular end extends through the slot in the collar to retain the hook in the board.

Alternatively, the mounting hook can be a reinforced double hook. This hook has two parallel linear display sections, with one L-shaped mounting section attached to one display section, and a straight mounting section on the other linear display section. This double hook is configured so that the mounting sections are mountable in vertically adjacent bores, with the L-shaped mounting section inserted into the upper bore.

In a further embodiment, the mounting hook is a reinforced double hook having the two display sections arranged in a horizontal plane. The display sections are connected by a looped section and the two L-shaped mounting sections are mountable in horizontally adjacent bores.

This assembly has a distinct advantage over the prior art display assemblies in that many more items can be displayed on a single board. In addition, the display hooks are very easy to insert into and remove from the board.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
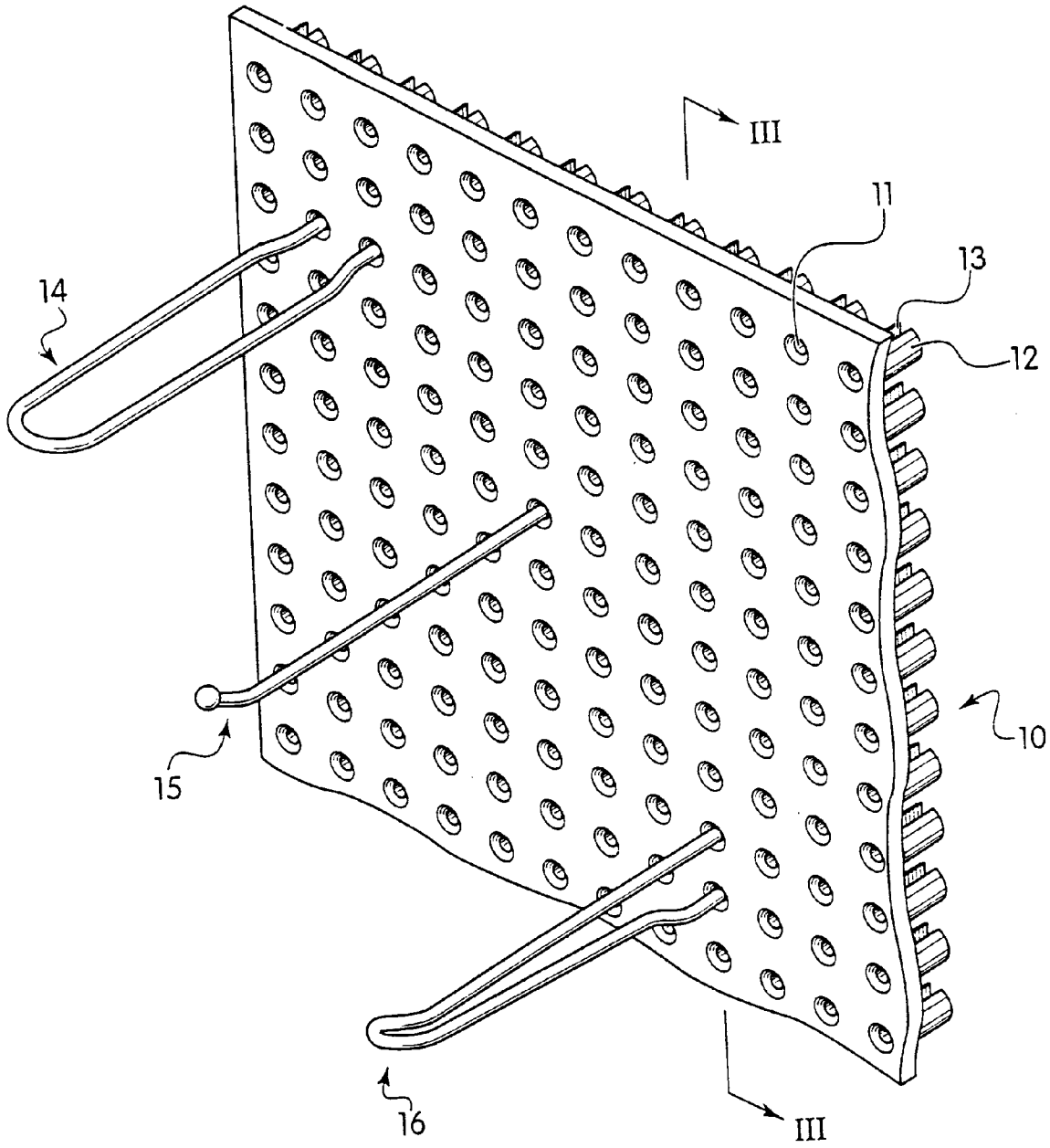
FIG. 1 shows a front perspective view of the display assembly according to the present invention.

Referring now in detail to the drawings and, in particular, FIG. 1, there is shown a perspective view of the merchandising display assembly according to the invention. The assembly is comprised of a planar mounting board 10 and a plurality of hooks 14, 15 and 16, which can be of various different shapes and sizes.

Mounting board 10 is formed from a substantially rigid material such as a stiff plastic so that it does not become deformed when heavy merchandise is displayed thereon. Mounting board 10 has a plurality of bores 11 extending therethrough. Bores 11 are preferably arranged with approximately ½ inch uniform spacing in sets of parallel rows and columns.

Figure 2:
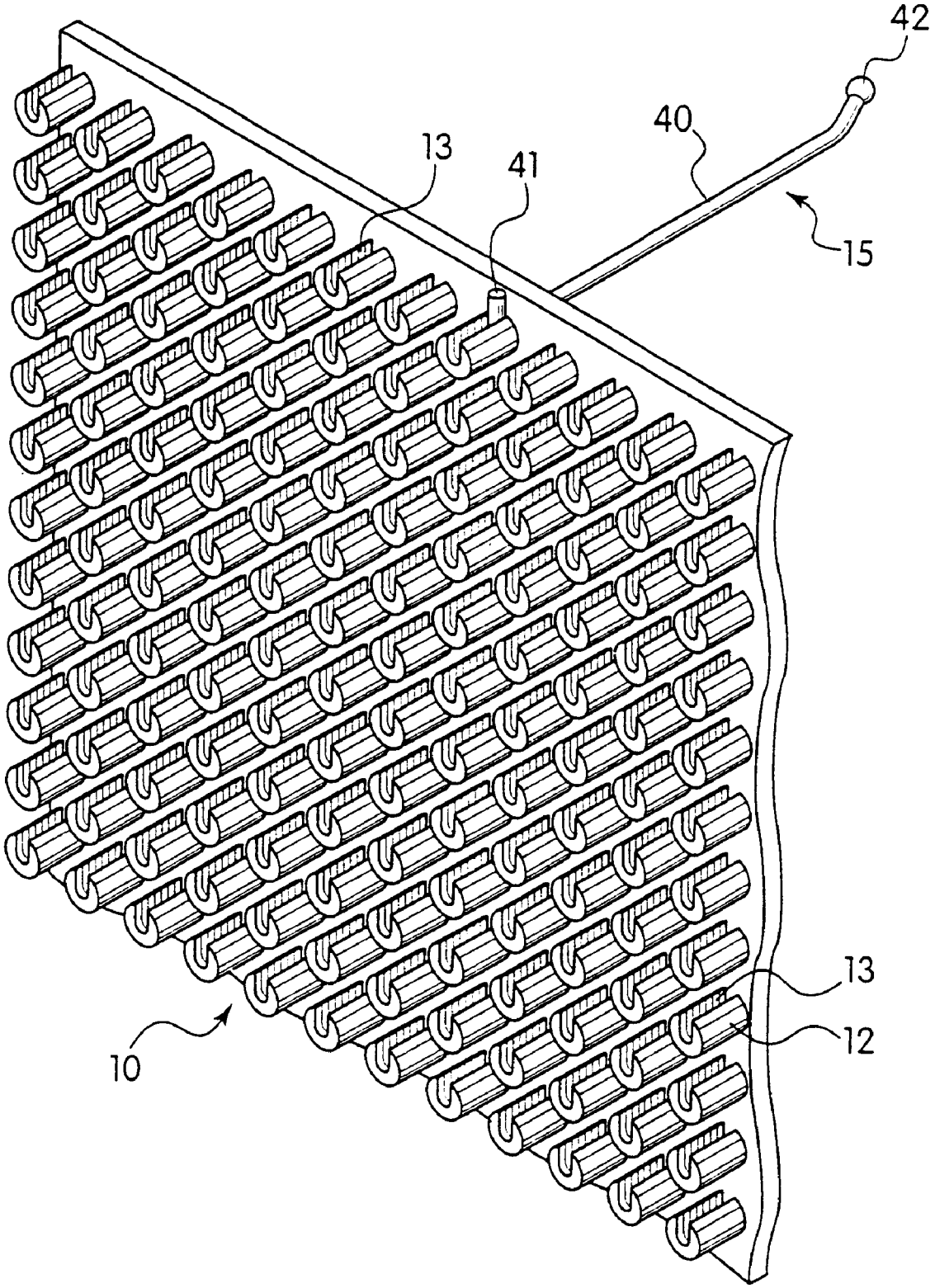
FIG. 2 shows a rear perspective view of the display assembly according to the invention.

As shown in FIG. 2, which shows a rear view of mounting board 10, a collar 12 extends back from each bore to provide a mounting area for the mounting hooks. Collar 12 has a longitudinal slot 13 extending along the topmost point of collar 12. Slot 13 is wide enough so that one of hooks 14–16 can fit through. Preferably, the length of collar 12 is at least three times the diameter of bore 11.

Figure 3:
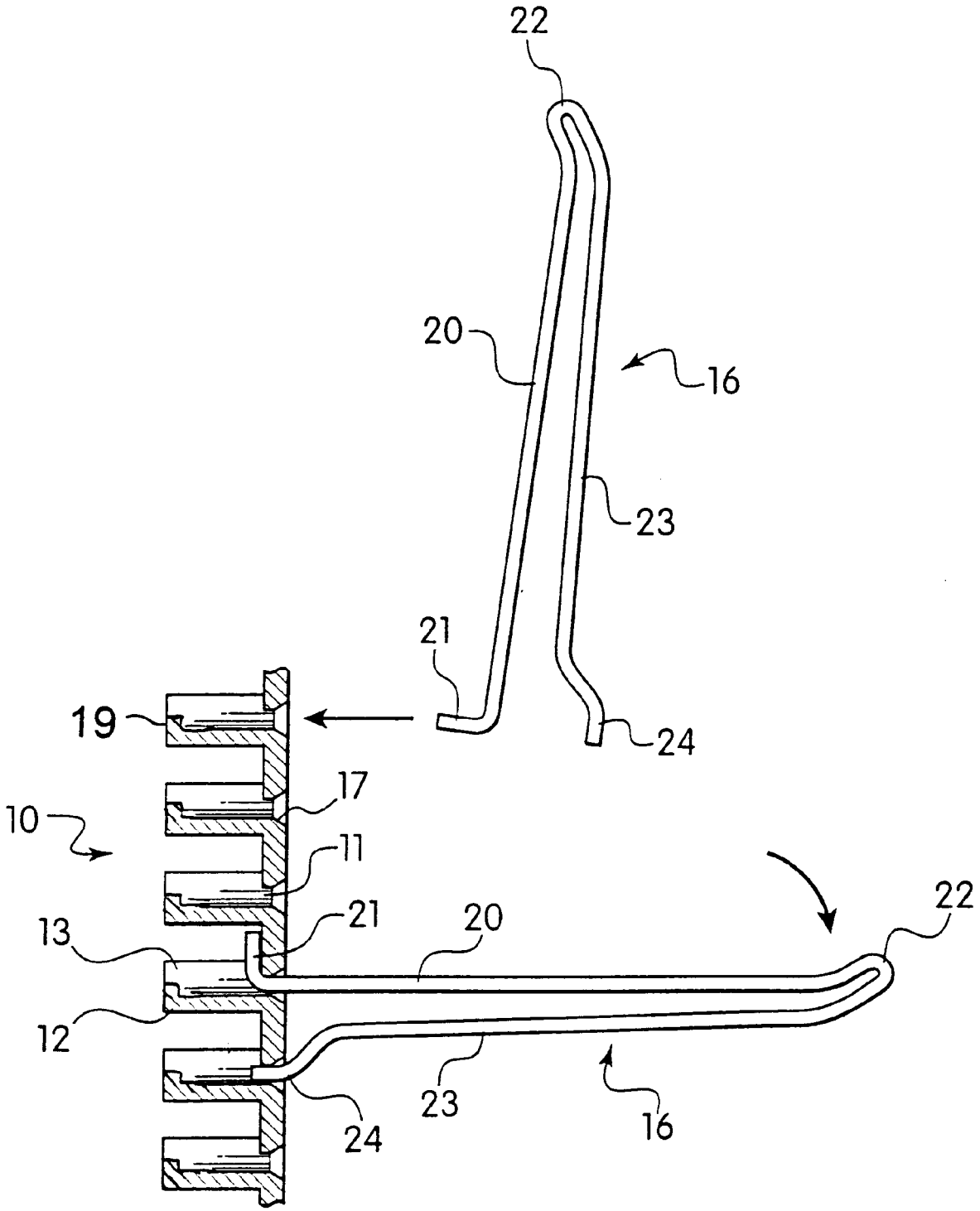
FIG. 3 shows a side cross-sectional view along lines III—III of FIG. 1.

As shown in FIG. 3, the rear face of collar 12 has a lip 19, which extends upward into bore 11. Lip 19 prevents any of the mounting hooks from moving beyond collar 12 into the space behind board 10. Also shown in FIG. 3, a hook 16, which is a two-pronged hook is inserted as follows: End 21 of hook 16 is first inserted into a bore 11 until end 21 is inserted to its maximum point. Then hook 16 is pivoted downward until end 24 reaches the next lower bore 11 and is also inserted through board 10. As hook 16 is pivoted, end 21 of hook 16 comes up through slot 13 and rests against the rear face of board 10. Collars 12 fit snugly around ends 21 and 24 and also serve to keep hook 16 in place.

To ease insertion of hooks 14–16 into bores 11, each bore 11 has a frusto-conical section 17, which is wider towards the front of board 10 and narrows to a defined diameter to fit snugly around the diameter of hooks 14–16. Preferably, the frusto-conical section forms an angle of approximately 45 degrees with respect to the front surface of the board 10.

A wide variety of different hooks can be used with board 10. The only requirement for the hooks are that they each have an L-shaped end section for inserting into the bores such that the L-shaped section can then extend up through the slot in the channel and retain the hook in the bore.

Figure 4:
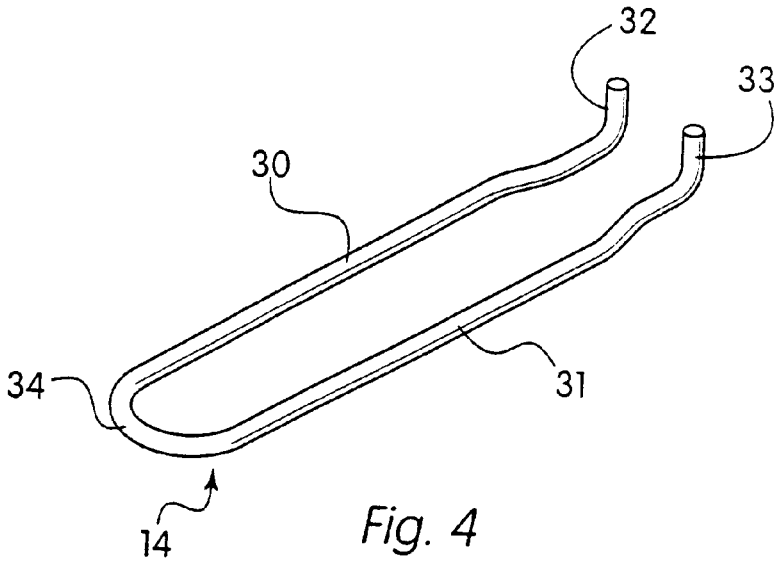
FIG. 4 shows a perspective view of a display hook for use in the display assembly according to the present invention.
Figure 5:
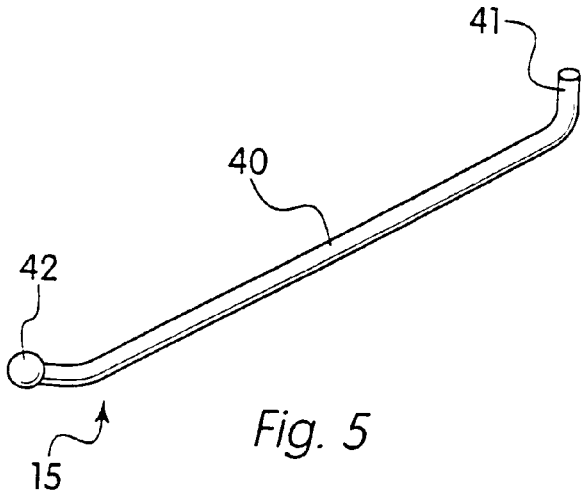
FIG. 5 shows an alternative display hook.
Figure 6:
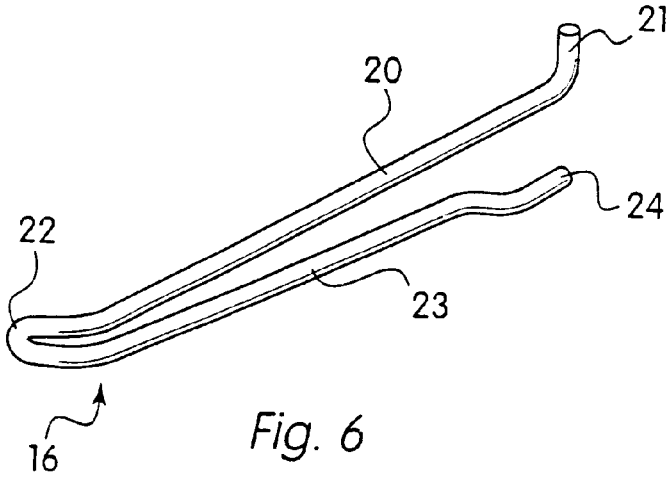
FIG. 6 shows another alternative display hook.

FIGS. 4–6 illustrate several varieties of mounting hooks for use with board 10. As shown in FIG. 4, hook 14 is a double hook consisting of two parallel display arms 30 and 31 connected by a looped portion 34. Each display arm 30 and 31 has an L-shaped bent end section 32 and 33, respectively. End sections 32 and 33 are spaced such that they fit into horizontally adjacent bores 11 on board 10. Hook 14 is then pressed downward, causing the perpendicular parts of bent end sections 32 and 33 to extend through slots 13 and come to rest against the rear surface of board 10.

FIG. 5 shows a single hook 15, which consists of a straight arm 40 with an L-shaped bent end 41 for insertion into a bore 11 on board 10. Hook 15 is then pivoted downward and end 41 is pushed through slot 13 to rest against the rear surface of board 10. Arm 40 may have a knob 42 on its free end to help retain the merchandise on hook 15.

An alternative hook 16 is shown in FIG. 6, and also in FIG. 3 described above. Hook 16 is comprised of two straight arms 20 and 23 connected by a looped portion 22. Arm 20 has an L-shaped end for insertion into bore 11 and through slot 13. Arm 23 has a straight end 24 for insertion into a vertically adjacent bore 11. The mounting of hook 16 onto board 10 is described above with reference to FIG. 3. Hook 16 is ideal for displaying heavier items in close side-by-side proximity, because it occupies only a single bore in the horizontal direction, while providing the stability of a double hook.

The display assembly according to the present invention provides a more versatile and efficient method of displaying merchandise. The board and hooks are simple and inexpensive to manufacture, and they allow many more items to be displayed than with a conventional pegboard assembly of similar size. The stiff plastic construction and thickness of the board ensure that the bores will not become eroded with heavy use, thus making the assembly according to the invention much more durable than with the prior art assemblies.

Accordingly, while only one embodiment of the present invention has been shown and described, it is obvious that many changes and modifications may be made thereunto without departing from the spirit and scope of the invention.

What is claimed is:

1. A merchandising display assembly for receiving display hooks for supporting and displaying articles of merchandise, comprising:

a planar mounting board having a flat front surface with a plurality of spaced apart bores extending therethrough in a predetermined pattern, and a rear surface;

a collar surrounding each bore and extending back from the rear surface, said collar comprising a cylindrical side wall having a longitudinally extending slot, wherein the length of each collar is at least three times the diameter of each bore and wherein each bore and collar is adapted to selectively receive and frictionally retain a mounting hook.

2. The merchandising display assembly according to claim 1, wherein the slot is disposed on the uppermost point of the collar.

3. The merchandising display assembly according to claim 1, wherein the predetermined bore pattern comprises parallel rows and columns with substantially uniform spacing between the bores of the rows and of the columns.

4. The merchandising display assembly according to claim 3, wherein the uniform spacing comprises approximately one-half (½) inch spacing on center between the bores of the rows and of the columns.

5. The merchandising display assembly according to claim 1, wherein said bore comprises a frusto-conical portion which forms an angle of approximately 45 degrees with respect to said front surface of said planar mounting board.

6. The merchandising display assembly according to claim 1, further comprising at least one mounting hook, said mounting hook comprised of a linear display section and an L-shaped mounting section having a perpendicular end, wherein said L-shaped mounting section is adapted for insertion into the bore such that said perpendicular end extends through the slot in the collar and rests against the rear surface of the board to retain the hook in the board.

7. The merchandising display assembly according to claim 6, wherein said mounting hook further comprises a looped portion extending from said linear display section and a lower leg portion having a straight mounting section, such that said two mounting sections are mountable in vertically adjacent bores.

8. The merchandising display assembly according to claim 6, wherein the mounting hook further comprises a second display section extending in a parallel plane with said display section and connected thereto by a looped section, and a second L-shaped mounting section attached to said second display section, such that said two L-shaped mounting sections are mountable in horizontally adjacent bores.

9. The display assembly according to claim 1, further comprising an upwardly-extending lip arranged on a rear portion of said collar opposite said slot, said lip preventing rearward movement of a mounting hook mounted in said collar.

* * * * *